US007343701B2

(12) United States Patent
Pare et al.

(10) Patent No.: US 7,343,701 B2
(45) Date of Patent: Mar. 18, 2008

(54) FOOTWEAR HAVING AN INTERACTIVE STRAPPING SYSTEM

(76) Inventors: Michael David Pare, 14149 Deep Lake Dr., Orlando, FL (US) 32826; Foy Chalk, Jr., 12324 Montana Ave., #8, Los Angeles, CA (US) 90049

( * ) Notice: Subject to any disclaimer, the term of this patent is extended or adjusted under 35 U.S.C. 154(b) by 209 days.

(21) Appl. No.: 11/006,338

(22) Filed: Dec. 7, 2004

(65) Prior Publication Data

US 2006/0117607 A1 Jun. 8, 2006

(51) Int. Cl.
*A43B 5/06* (2006.01)
*A43B 7/20* (2006.01)

(52) U.S. Cl. ..... 36/50.1; 36/88

(58) Field of Classification Search ..... 36/50.1, 36/88, 91, 92

See application file for complete search history.

(56) References Cited

U.S. PATENT DOCUMENTS 2,788,591 A * 4/1957 Gibson ..... 36/11.5
4,679,334 A * 7/1987 McBride ..... 36/114
4,811,500 A * 3/1989 Maccano ..... 36/91
5,271,130 A * 12/1993 Batra ..... 24/714.6
5,291,671 A * 3/1994 Caberlotto et al. ..... 36/88
5,319,869 A * 6/1994 McDonald et al. ..... 36/114
5,819,439 A * 10/1998 Sanchez ..... 36/89
5,909,946 A * 6/1999 Okajima ..... 36/50.1
5,950,335 A * 9/1999 Okajima ..... 36/115
5,992,057 A * 11/1999 Monti ..... 36/89
6,119,372 A * 9/2000 Okajima ..... 36/50.1
6,128,834 A * 10/2000 Vecchiola et al. ..... 36/11.5
6,128,835 A * 10/2000 Ritter et al. ..... 36/45
6,151,804 A * 11/2000 Hieblinger ..... 36/128
6,505,424 B2 * 1/2003 Oorei et al. ..... 36/129
2004/0181972 A1 * 9/2004 Csorba ..... 36/50.1

* cited by examiner

*Primary Examiner*—Marie Patterson
(74) *Attorney, Agent, or Firm*—Akerman Senterfitt; Jon M. Gibbs

(57) ABSTRACT

The first illustrative embodiment includes a lace or strap which runs behind the heel down the sides of the foot, under the sole of the foot, crosses to opposite sides of the foot, comes up over the toes ending in a cinch. Loops and slots are provided in the shoe to accommodate the additional strap. The second illustrative embodiment includes a heel strap which runs behind the heel, down the sides of the foot where it engages a loop near the bottom of the foot and loops over to the top of the foot where it engages opposite sides of a conventional lace. Tightening of the conventional lace causes a tightening of this heel strap. The second embodiment also includes a toe strap which is attached to opposite sides of the sole, crosses over the sole to opposite sides of the toes, loops over the toes and engages the bottom of a conventional lace. Tightening of the conventional lace causes a tightening of the toe strap.

11 Claims, 5 Drawing Sheets

FOOTWEAR HAVING AN INTERACTIVE STRAPPING SYSTEM

BACKGROUND OF THE INVENTION

1. Field of the Invention

The invention relates to footwear. More particularly, the invention relates to an athletic shoe having lacing which wraps around the toe and the heel.

2. Brief Description of the Prior Art

Traditional athletic shoes have upper central exterior lacing systems. These lacing systems are typically channeled through one or more eyelets that are generally positioned on both sides of the center top of the shoe. This type of design fails to provide adequate support to an athlete by limiting the securing area to generally the upper portion of the foot. For example, in sports applications these traditional designs may be physically dangerous to an athlete by allowing the athlete's foot to slide or otherwise move within the shoe during use.

Several attempts have been made to overcome the above-mentioned deficiencies. For example, designs have been proposed wherein the lace system is entirely internal and/or where the lace system wraps around only the heel portion of a shoe to provide a better means for securing the foot within the shoe. Two noteworthy examples of such designs are illustrated in U.S. Pat. No. 5,269,078 to Cochrane and U.S. Pat. No. 6,286,233 to Gaither.

Cochrane discloses an apparatus for supplying supporting force in a boot or the like having predetermined first and second sides, the apparatus having a force applying system including a plurality of first securing points mounted in substantially fixed relation on the boot on the first side, a second securing point mounted in substantially fixed relation on the boot on the second side and a force applying member linking through the system the first securing points and the second securing point and adapted to draw the first and second securing points substantially toward each other to apply a selected force capturing the foot in the boot.

Gaither discloses an internal lacing system for footwear wherein a plurality of lace guides having rotatable rollers are secured and strategically positioned throughout a shoe to facilitate the securing of the foot within the shoe. An elongated lace having a first end and a second end is internally channeled through each of the lace guides and over the respective rollers, wherein the second end of the elongated lace exits the internal of the shoe at the upper portion of the shoe proximal to the shoe opening. The first end of the elongated lace is secured within the shoe proximal to the toe area of the shoe. To tighten the shoe, a user pulls on the exposed second end of the lace thereby allowing the lace to roll along each respective roller positioned within each lace guide.

These designs teach the use of internal lacing systems or heel lacing in boots and incorporate more complicated and/or bulky fastening means and thus, are not suitable for typical shoes, especially athletic shoes. Moreover, lacing systems that only wrap around the heel of the shoe do not provide maximum securing of the entire foot within the shoe.

SUMMARY OF THE INVENTION

It is therefore an object of the invention to provide an improved lacing system for athletic shoes.

It is also an object of the invention to provide an improved lacing system for athletic shoes which provides improved support.

It is another object of the invention to provide an improved lacing system for athletic shoes which is not complicated.

It is yet another object of the invention to provide an improved lacing system for athletic shoes which is not bulky.

It is another object of the invention to provide an improved lacing system for athletic shoes which provides maximum securing of the entire foot within the shoe.

It is also an object of the invention to provide an interactive strapping system for athletic shoes.

It is another object of the invention to provide an interactive strapping system for athletic shoes which provides additional heel and arch support.

It is yet another object of the invention to provide an interactive strapping system for athletic shoes which should help to eliminate shin splints, Achilles and knee injuries.

It is still another object of the invention to provide an interactive strapping system for athletic shoes which shifts the focus of impact to the ball of the foot.

It is also an object of the invention to provide an interactive strapping system for athletic shoes which locks the foot forward to help initiate a proper hollow tumbling position.

In accord with these objects which will be discussed in detail below, an athletic shoe according to the invention includes a lacing system which covers the heel and the toe as well as the conventional lacing positions. Two embodiments are provided. The first illustrative embodiment includes a lace or strap which runs behind the heel down the sides of the foot, under the sole of the foot, crosses to opposite sides of the foot, comes up over the toes ending in a cinch. Loops and slots are provided in the shoe to accommodate the additional strap.

The second illustrative embodiment includes a heel strap which runs behind the heel, down the sides of the foot where it engages a loop near the bottom of the foot and loops over to the top of the foot where it engages opposite sides of a conventional lace. Tightening of the conventional lace causes a tightening of this heel strap. The second embodiment also includes a toe strap which is attached to opposite sides of the sole, crosses over the sole to opposite sides of the toes, loops over the toes and engages the bottom of a conventional lace. Tightening of the conventional lace causes a tightening of the toe strap.

The interactive strapping system of the invention provides additional heel and arch support, helps to eliminate shin splints, Achilles and knee injuries. It shifts the focus of impact to the ball of the foot. It locks the foot forward to help initiate a proper hollow tumbling position.

The presently preferred embodiment includes "bubble laces" which stay cinched even if they become untied.

DETAILED DESCRIPTION

Figure 1:
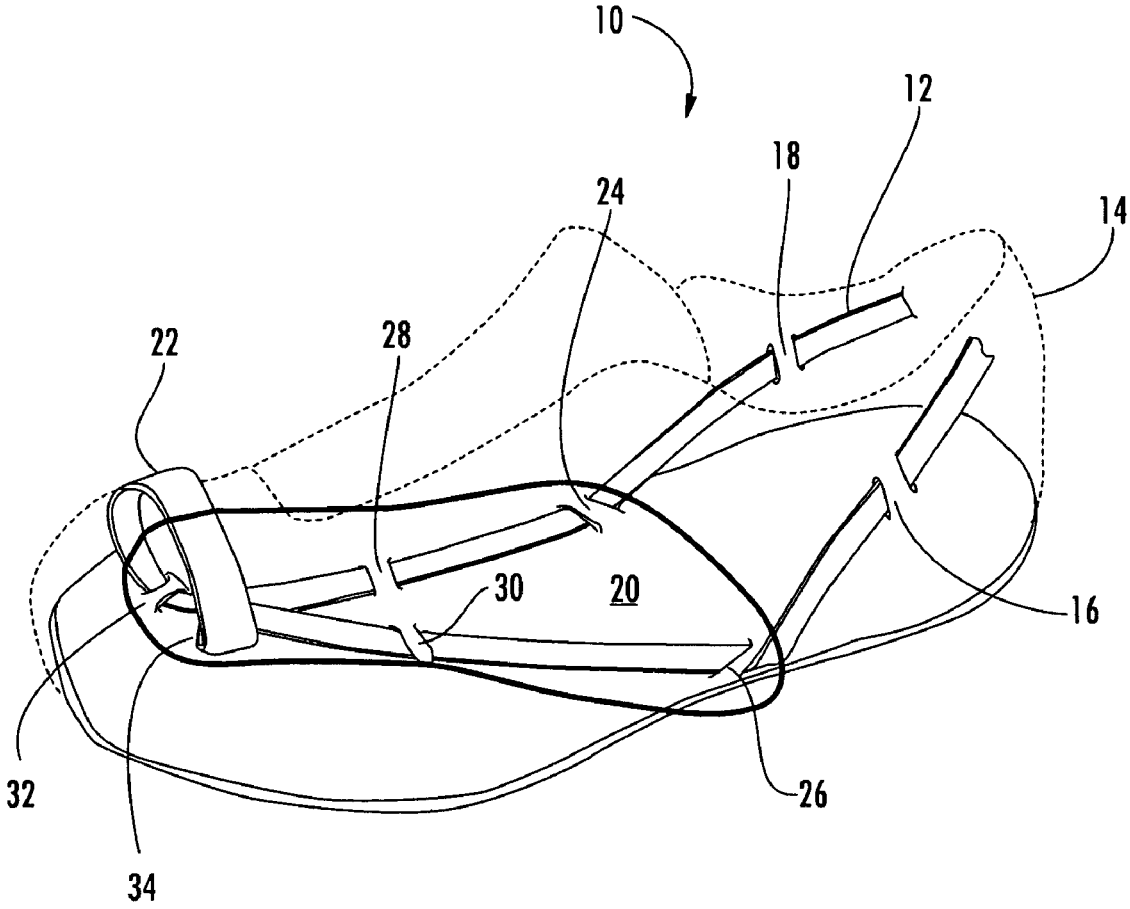
FIG. 1 is a schematic perspective view of a first illustrative embodiment of the invention.
Figure 2:
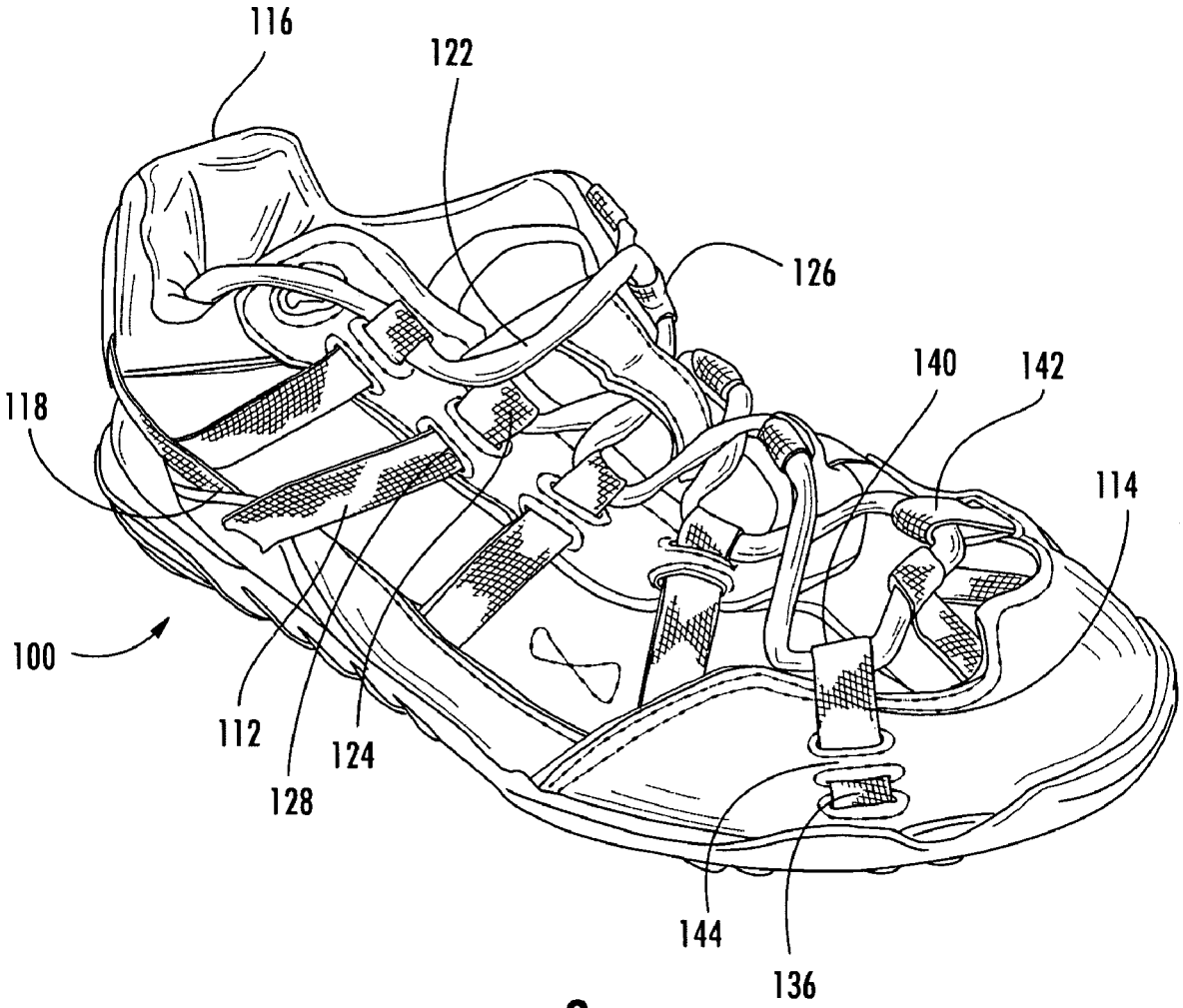
FIG. 2 is a head on perspective view of a second illustrative embodiment of the invention.
Figure 3:
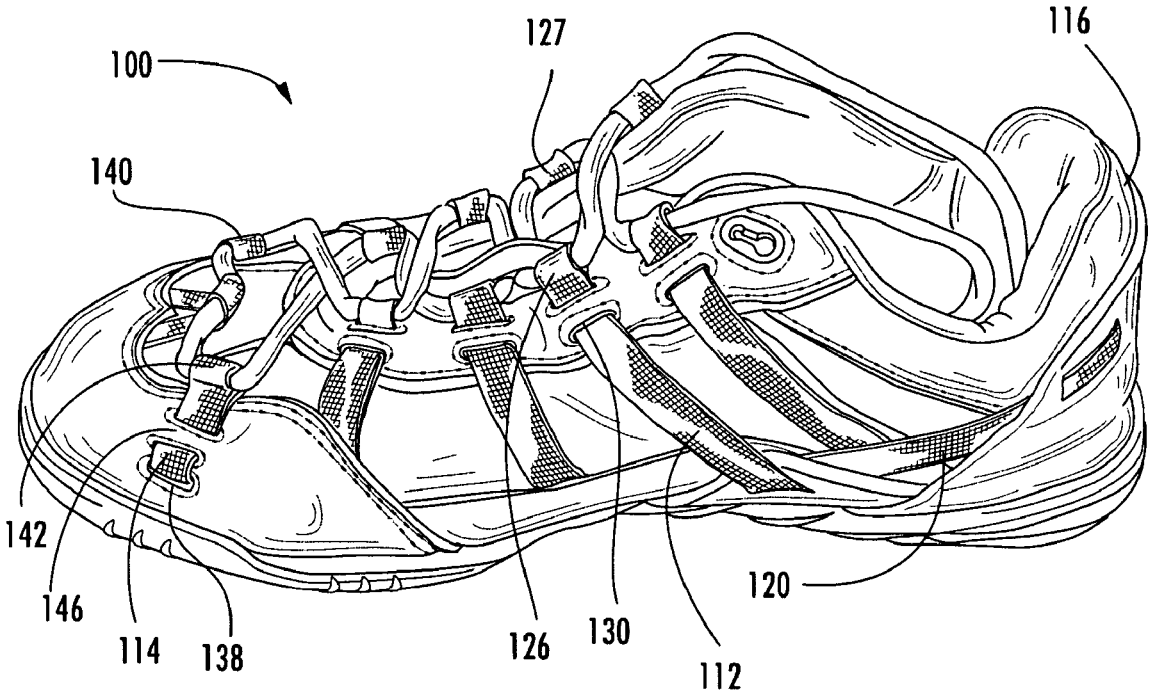
FIG. 3 is a side perspective view of the second illustrative embodiment.
Figure 4:
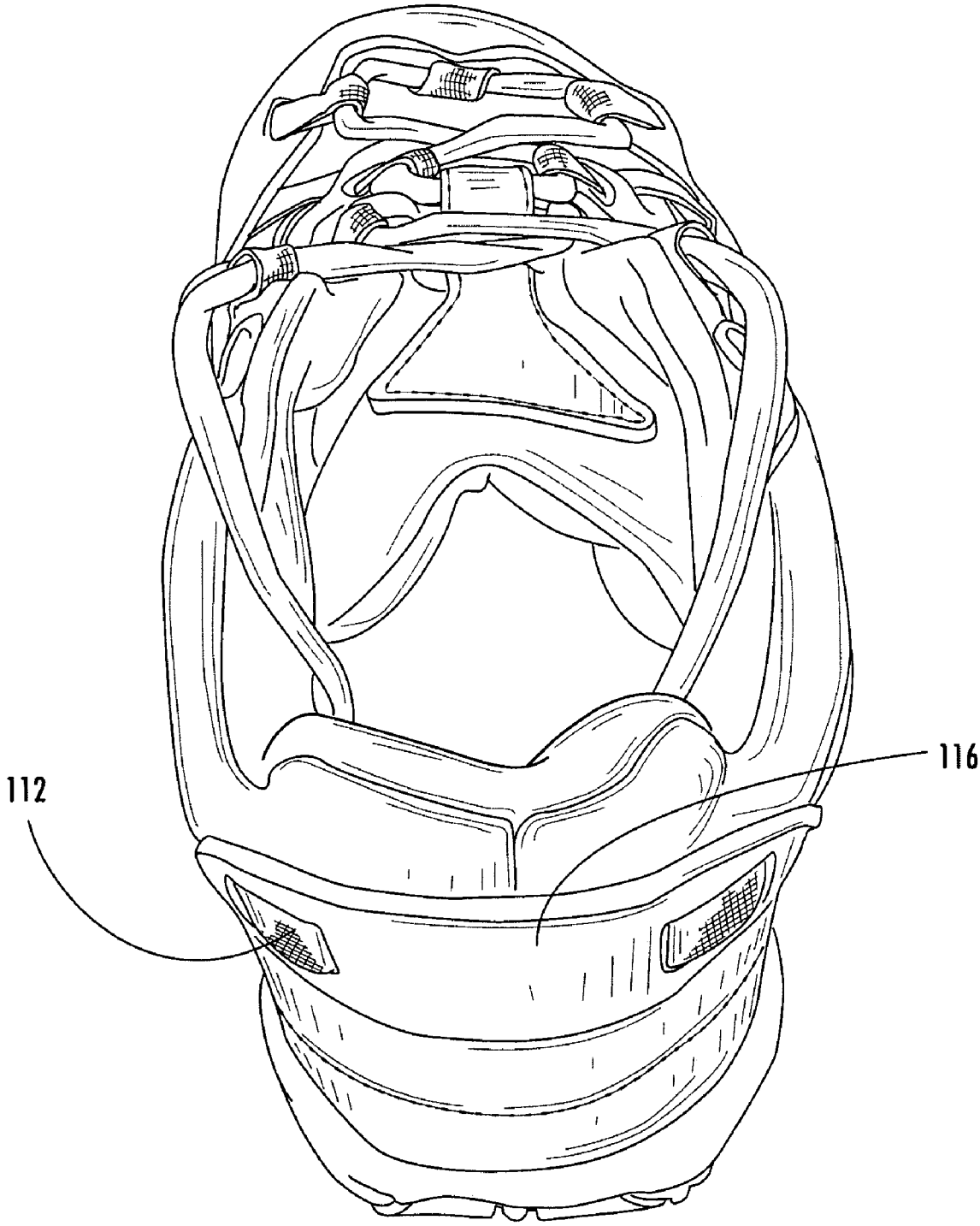
FIG. 4 is a rear perspective view of the second illustrative embodiment.

Turning now to FIG. 1, the first illustrative embodiment of a shoe 10 according to the invention includes a lace or strap 12 which runs behind the heel 14 down the sides 16, 18 of the foot, under the sole 20 of the foot, crosses to opposite sides of the foot, comes up over the toes 22 ending in a cinch, preferably VELCRO. Loops and slots 16, 18, 24, 26, 28, 30, 32, 34 are provided in the shoe to accommodate the additional strap. The heel portion at 14 is preferably completely enclosed so that the strap does not cut into the heel when it is tightened. The strap 12 is preferably flat and ¼ to ¾ inch wide. A foam sole cushion (not shown) is preferably placed inside the shoe covering the interior sole 20.

Referring now to FIGS. 2-5, the second illustrative embodiment of a shoe 100 according to the invention includes a heel strap 112 and a toe strap 114. The heel strap 112 runs behind the heel 116, down the sides of the foot where it engages a loop 118, 120 near the bottom of the foot on each side and loops over to the top of the foot where it engages opposite sides of a conventional lace 122. This engagement is shown by loops 124, 126 through which the conventional lace 122 is threaded. Tightening of the conventional lace 122 causes a tightening of this heel strap 112. Though not essential, strap 112 passes through loops 128, 130 on the exterior of the shoe before joining with the conventional lace 122. As seen best in FIG. 4, the heel portion 116 completely covers the strap 112 so that it does not cut into the heel of the wearer when tightened.

Figure 5:
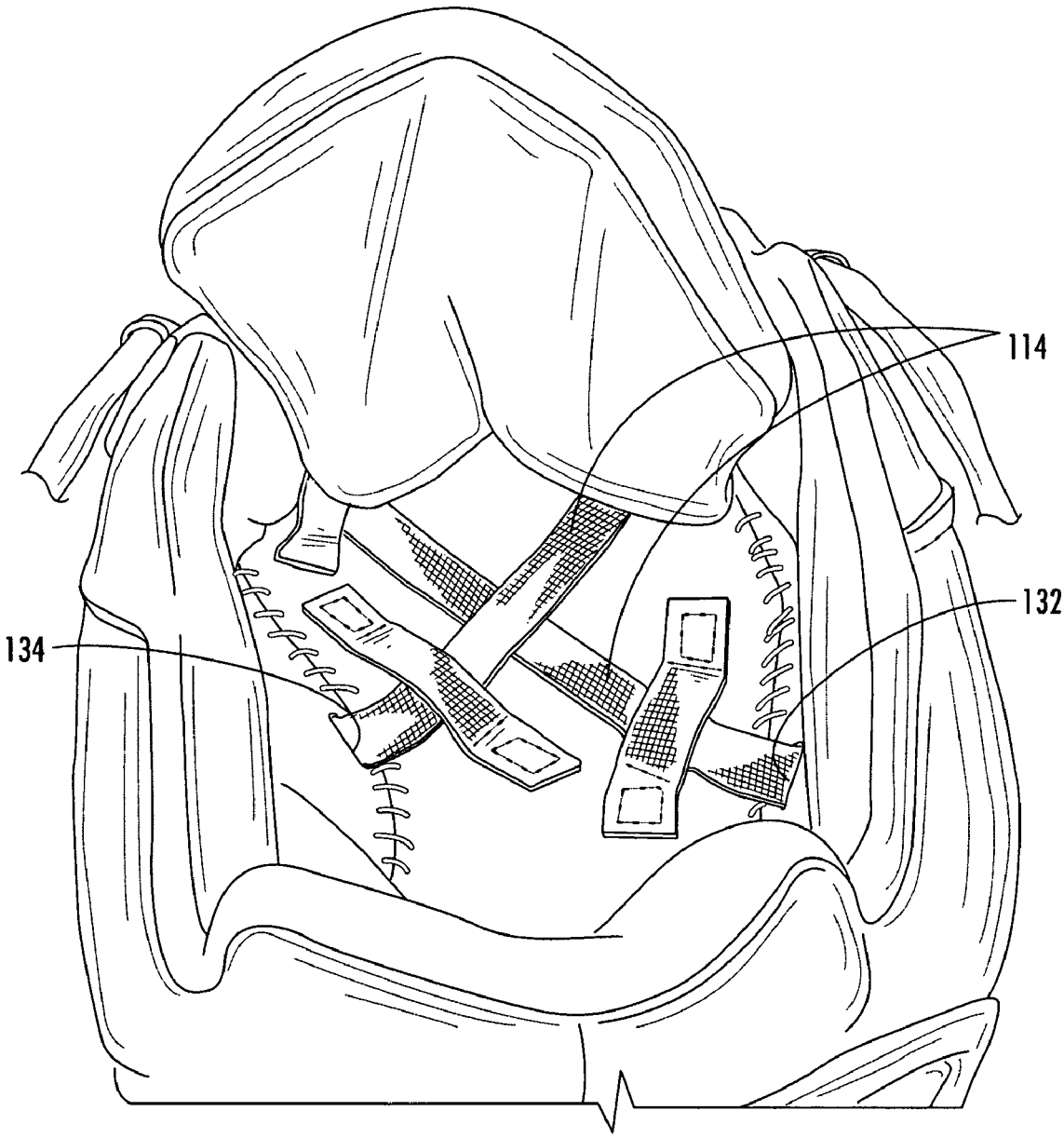
FIG. 5 is an interior view of the second embodiment illustrating the crossing of the toe strap.

The toe strap 114 is attached to opposite sides of-the sole 132, 134 as seen best in FIG. 5. It crosses over the sole to opposite sides of the toes 136, 138, loops over the toes and engages the bottom of the conventional lace 122 as seen best in FIGS. 2 and 3. The engagement of the conventional lace 122 is shown by loops 140, 142. Tightening of the conventional lace 122 causes a tightening of the toe strap 114. Though not essential, the strap 114 passes through loops 144, 146 on the exterior of the shoe before joining with the conventional lace 122. As seen best in FIG. 5, loops are provided in the sole as in the first embodiment to guide the strap as it crosses itself from one side to the other. A foam pad (not shown) is preferably placed in the shoe covering the sole on top of the strap 114.

The interactive strapping system of the invention provides additional heel and arch support, should help to eliminate shin splints, Achilles and knee injuries. It shifts the focus of impact to the ball of the foot. It locks the foot forward to help initiate a proper hollow tumbling position.

It will be appreciated that the straps of the invention are partially visible on the exterior of the shoe and partially hidden inside the shoe. Thus, the straps should be chosen to have a color which is aesthetically compatible with the exterior shoe color. In addition, where the strap exits to the exterior of the shoe, it is desirable to provide a rectangular plastic eyelet so that the strap may move without damaging the shoe. The straps are preferably made of nylon. The heel strap preferably crosses over the heel just above where the back of the heel curves inward. According to the preferred embodiment, the conventional lace 122 is a "bubble lace" which will stay cinched even if it becomes untied.

There have been described and illustrated herein an interactive strapping system for an athletic shoe. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A shoe, comprising:

a toe portion, a heel portion and a sole portion;

a toe portion comprising a first through slot on a first side of said toe portion and a second through slot through a second side of said toe portion;

a first toe strap connected to a shoe lace at a first end passing through said first through slot of said toe portion and connected to the sole portion;

a second toe strap connected to said shoe lace at a first end passing through said second through slot of said toe portion and connected to the sole portion;

a heel portion comprising a first through slot proximate the sole portion on a first side of said heel portion, a second through slot on said first side of said heel portion, a third through slot on a second side of said heel portion and a fourth through slot proximate the sole portion on said second side of said heel portion; and a heel strap connected at a first end to said shoe lace wherein said heel strap passes through said first through slot of said heel portion, said second through slot of said heel portion, said third through slot of said heel portion and said fourth through slot of said heel portion and connected at a second end to said shoe lace.

2. The shoe according to claim 1, wherein said shoe lace is connected to said heel strap through loops at each end of said heel strap.

3. The shoe according to claim 1, wherein said shoe lace is connected to said first toe strap and said second toe strap through loops at the first ends of said first and second toe straps.

4. The shoe according to claim 1, further comprising a foam pad disposed inside of said shoe covering said sole portion.

5. A shoe, comprising:

a toe portion, a heel portion and a sole portion;

a toe portion comprising a first through slot on a first side of said toe portion and a second through slot through a second side of said toe portion;

a first toe strap connected to a shoe lace at a first end passing through said first through slot of said toe portion and connected to the sole portion;

a second toe strap connected to said shoe lace at a first end passing through said second through slot of said toe portion and connected to the sole portion;

a heel portion comprising a first through slot proximate the sole portion on a first side of said heel portion, a second through slot on said first side of said heel portion, a third through slot on a second side of said heel portion and a fourth through slot proximate the sole portion on said second side of said heel portion;

a heel strap connected at a first end to said shoe lace wherein said heel strap passes through said first through slot of said heel portion, said second through slot of said heel portion, said third through slot of said heel portion and said fourth through slot of said heel portion and connected at a second end to said shoe lace; and a foam pad disposed inside of said shoe covering said sole portion.

6. The shoe according to claim 5, wherein said shoe further comprises an orthopedic arch support.

7. A shoe, comprising:

a toe portion, a tongue portion, a heel portion and a sole portion;

a toe portion comprising a first through slot on a first side of said toe portion and a second through slot through a second side of said toe portion;

a first toe strap connected to a shoe lace at a first end passing through said first through slot of said toe portion and connected to the sole portion;

a second toe strap connected to said shoe lace at a first end passing through said second through slot of said toe portion and connected to the sole portion;

a tongue portion comprising a tongue and a plurality of eyelets for receiving said shoe lace;

a heel portion comprising a first through slot proximate the sole portion on a first side of said heel portion, a second through slot on said first side of said heel portion, a third through slot on a second side of said heel portion and a fourth through slot proximate the sole portion on said second side of said heel portion; and a heel strap connected at a first end to said shoe lace wherein said heel strap passes through said first through slot of said heel portion, said second through slot of said heel portion, said third through slot of said heel portion and said fourth through slot of said heel portion and connected at a second end to said shoe lace.

8. The shoe according to claim 7, wherein said tongue portion further comprises a plurality of through slots for receiving said heel strap.

9. A shoe, comprising:

a toe portion, a tongue portion, a heel portion and a sole portion;

a toe portion comprising a first through slot on a first side of said toe portion and a second through slot through a second side of said toe portion;

a first toe strap connected to a shoe lace at a first end passing through said first through slot of said toe portion and connected to the sole portion;

a second toe strap connected to said shoe lace at a first end passing through said second through slot of said toe portion and connected to the sole portion;

a tongue portion comprising a tongue and a plurality of eyelets for receiving said shoe lace;

a heel portion comprising a first through slot proximate the sole portion on a first side of said heel portion, a second through slot on said first side of said heel portion, a third through slot on a second side of said heel portion and a fourth through slot proximate the sole portion on said second side of said heel portion;

a heel strap connected at a first end to said shoe lace wherein said heel strap passes through said first through slot of said heel portion, said second through slot of said heel portion, said third through slot of said heel portion and said fourth through slot of said heel portion and connected at a second end to said shoe lace; and a foam pad disposed inside of said shoe covering said sole portion.

10. A shoe, comprising:

a toe portion, a tongue portion, a heel portion and a sole portion;

a toe portion comprising a first through slot on a first side of said toe portion and a second through slot through a second side of said toe portion;

a first toe strap connected to a shoe lace at a first end passing through said first through slot of said toe portion and connected to the sole portion;

a second toe strap connected to said shoe lace at a first end passing through said second through slot of said toe portion and connected to the sole portion;

a tongue portion comprising a tongue and a plurality of eyelets for receiving said shoe lace, further comprising a plurality of through slots for receiving a heel strap;

a heel portion comprising a first through slot proximate the sole portion on a first side of said heel portion, a second through slot on said first side of said heel portion, a third through slot on a second side of said heel portion and a fourth through slot proximate the sole portion on said second side of said heel portion;

a heel strap connected at a first end to said shoe lace wherein said heel strap passes through said first through slot of said heel portion, said second through slot of said heel portion, said third through slot of said heel portion and said fourth through slot of said heel portion and connected at a second end to said shoe lace; and a foam pad disposed inside of said shoe covering said sole portion.

11. The shoe according to claim 10, wherein said shoe further comprises an orthopedic arch support.

* * * * *